United States Patent [19]

Hayakawa et al.

[11] Patent Number: 4,838,588

[45] Date of Patent: Jun. 13, 1989

[54] DOOR LOCK DEVICE FOR AUTOMOTIVE VEHICLE

[75] Inventors: Hatsuo Hayakawa; Mikio Honma, both of Yokohama, Japan

[73] Assignee: Ohi Seisakusho Co., Ltd., Yokohama, Japan

[21] Appl. No.: 36,720

[22] Filed: Apr. 10, 1987

[30] Foreign Application Priority Data

| | | | |
|---|---|---|---|
| Apr. 16, 1986 | [JP] | Japan | 61-87569 |
| Jun. 20, 1986 | [JP] | Japan | 61-144104 |
| Jun. 20, 1986 | [JP] | Japan | 61-144103 |
| Oct. 24, 1986 | [JP] | Japan | 61-163024 |

[51] Int. Cl.[4] ..... E05C 3/26

[52] U.S. Cl. ..... 292/216; 292/337

[58] Field of Search ..... 292/216, 280, 337, DIG. 53, 292/DIG. 64

[56] References Cited

U.S. PATENT DOCUMENTS

| | | | |
|---|---|---|---|
| 2,637,464 | 5/1953 | Vogel, Jr. | 292/259 X |
| 3,674,296 | 7/1972 | Wanlass et al. | 292/216 |
| 4,073,519 | 2/1978 | Kuroza et al. | 292/216 |
| 4,586,737 | 5/1986 | Arlauskas | 292/216 |
| 4,679,836 | 7/1987 | Pupillo et al. | 292/216 |

FOREIGN PATENT DOCUMENTS

| | | |
|---|---|---|
| 2250452 | 3/1976 | Fed. Rep. of Germany . |
| 57-137280 | 2/1956 | Japan . |
| 59-51959 | 4/1984 | Japan . |

*Primary Examiner*—Richard E. Moore

*Attorney, Agent, or Firm*—Foley & Lardner, Schwartz, Jeffery, Schwaab, Mack, Blumenthal & Evans

[57] ABSTRACT

To increase strength or rigidity of a door lock device for an automotive vehicle, the box-shaped base housing and the cover plate are formed in enclosed cross section by connecting two flange portions thereof. Further, the base housing and the cover plate are connected via two axles for supporting the latch and the lock plate. On the other hand, to facilitate assembling work of the door lock device, an actuator machanism including a latch release lever, a lock/unlock plate, and an engage lever is directly attached to the cover plate without increasing the mounting space.

2 Claims, 7 Drawing Sheets

DOOR LOCK DEVICE FOR AUTOMOTIVE VEHICLE

BACKGROUND OF THE INVENTION

1. Field of the Invention

The present invention relates to a door lock device for an automotive vehicle and more specifically to a back door lock device suitably mounted on a back door for an automotive vehicle.

2. Description of the Prior Art

An example of prior-art back door lock device for an automotive vehicle is disclosed in Japanese Published Unexamined Utility Model Appl. No. 57-137280, for instance. In this lock device, the housing is formed by joining a flat front base to a box-shaped rear base in such a way that the front base is fixed to the bottom wall of the rear base by a latch axle for pivotably supporting the latch, and further the striker guide opening is formed in the rear base.

In the prior-art door lock device as described above, since the rear base is formed open due to the presence of a striker guide opening, the rear base is weak in rigidity and therefore subjected to deformation in case shock is applied thereto.

That is, there exist problems such that the striker guide opening is widened open; the rear base and the front base are bent inwardly or outwardly; and the latch supported by the base is released and therefore the striker is removed from the lock device in case a strong shock is applied to the lock device due to an accident, for instance.

On the other hand, Japanese Published Unexamined Utility Model Appl. No. 59-51959 discloses another example of door lock device for an automotive vehicle. In this lock device, a latch mechanism is disposed separately from an actuator mechanism connected to an actuator or operation levers to release latch or to lock or unlock the latch.

This is because where the lock device is attached to a back door, the lock device is usually disposed at the free end of a back door within a small space and therefore the lock device should be small in size.

In the prior-art door lock device as described above, however, since the latch mechanism and the actuator mechanism are assembled separately, both the mechanisms should be connected by link members, thus resulting in other problems such that the adjustment is complicated, the assembling workability is lowered, and therefore the cost thereof is high.

SUMMARY OF THE INVENTION

With these problems in mind, therefore, it is the primary object of the present invention to provide a door lock device for an automotive vehicle which is resistant to shock.

The other object of the present invention is to provide a door lock device for an automotive vehicle which is small in size including both a latch mechanism and an actuator mechanism together within a relatively small space.

To achieve the above-mentioned objects, the door lock device for an automotive vehicle according to the present invention comprises: a base housing having two mounting flange portions on both sides thereof, respectively; a cover plate having two joint flange portions on both sides thereof, respectively so as to form an enclosed cross-section housing in cooperation with said base housing when the two mounting flange portions and the two joint flange portions are fixed to each other, respectively; and a latch and a lock plate pivotably supported by two support axles fixed between said base housing and said cover plate, for locking the stricker coming into said lock device.

To achieve the above-mentioned second object, the door lock device for an automotive vehicle according to the present invention further comprises: a latch release lever pivotably supported by said cover plate and having a first end connectable to latch release means; a lock/unlock plate pivotably supported by said cover plate coaxially with said latch release lever and having a first end connectable to lock/unlock means; and an engage lever having a pivotal end pivotably supported by a second end of said latch release lever, a free end slidably supported by a second end of said lock/unlock plate, and an intermediate end formed at such a position that when said lock/unlock plate is set to an unlock position and said latch release lever is actuated, said intermediate end is brought into contact with an actuate end of said lock plate to release the striker from said latch, and when said lock/unlock plate is set to a lock position and said latch release lever is actuated, said intermediate end is moved away from the actuate end of said lock plate without releasing the striker from said latch.

To further increase the strength, the base housing is formed with a bead extending inwardly and over an area between said latch and said lock plate so as to prevent said latch from being disengaged from said lock plate when shock is applied thereto. Furthermore, said cover plate is formed with seats and straight beads to further increase the strength of the lock device against shock.

In the lock device according to the present invention, since the housing is formed in enclosed cross section by the box-shaped base housing and the cover plate and further these two housing and cover plates are fixed by the latch support axle and the lock plate axle, it is possible to fairly improve the strength and the rigidity of the lock device housing against a strong shock.

In assembling work of the lock device according to the present invention, the latch mechanism (housing) is fixed to an end of a back door and then the actuator mechanism is connected to the housing, so that the assembling work is simplified. When the lock/unlock plate is set to unlock position and then the latch release lever is actuated to move the engage lever, since the intermediate end thereof is brought into contact with the actuate end of the lock plate, it is possible to release the striker from the latch. On the other hand, when the lock/unlock plate is set to lock position, since the engagement between the intermediate end and the actuate end is disabled, it is impossible to release the striker from the latch.

BRIEF DESCRIPTION OF THE DRAWINGS

The features and advantages of the door lock device for an automotive vehicle according to the present invention will be more clearly appreciated from the following description taken in conjunction with the accompanying drawings in which like reference numeral designate the same or similar elements or sections throughout the figures thereof and in which.

DETAILED DESCRIPTION OF THE PREFERRED EMBODIMENTS

With reference to the attached drawings, embodiments of a door lock device for an automotive vehicle according to the present invention will be described hereinbelow.

Figure 1A:
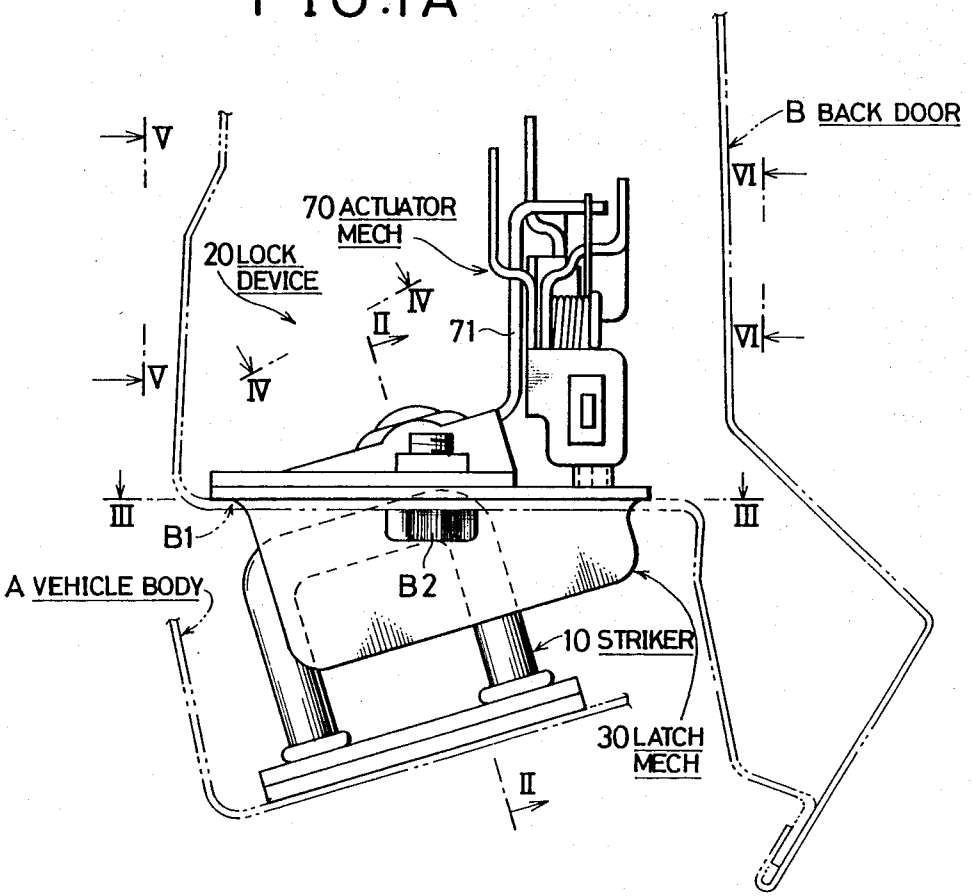
FIG. 1A is a side view showing a door lock device for an automotive vehicle according to the present invention, which is attached to a back door of a vehicle.

In FIG. 1A, a striker 10 is attached to a rearmost end of a vehicle body A, and a back door lock device 20 of the present invention is attached to an end surface B1 of a vehicle back door B from inside. The lock device 20 is roughly divided into two sections: a latch mechanism 30 including a latch 40 and a lock plate 50 (as depicted in FIG. 3B) and an actuator mechanism 70 disposed outside the latch mechanism 30.

Figure 1B:
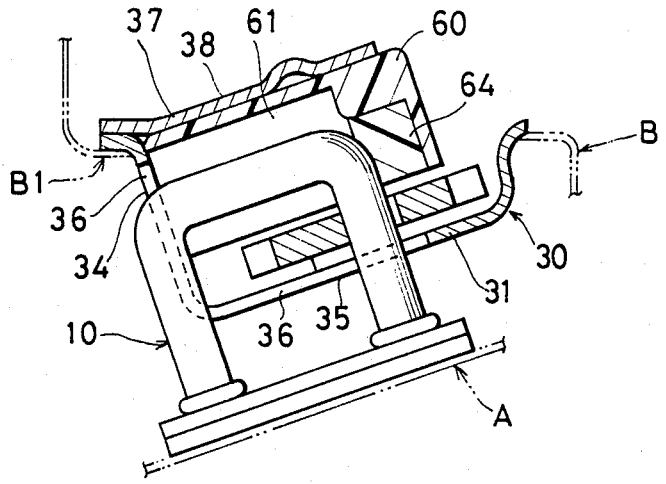
FIG. 1B is a partial side cross-sectional view showing only a latch mechanism of the door lock device shown in FIG. 1A.
Figure 2:
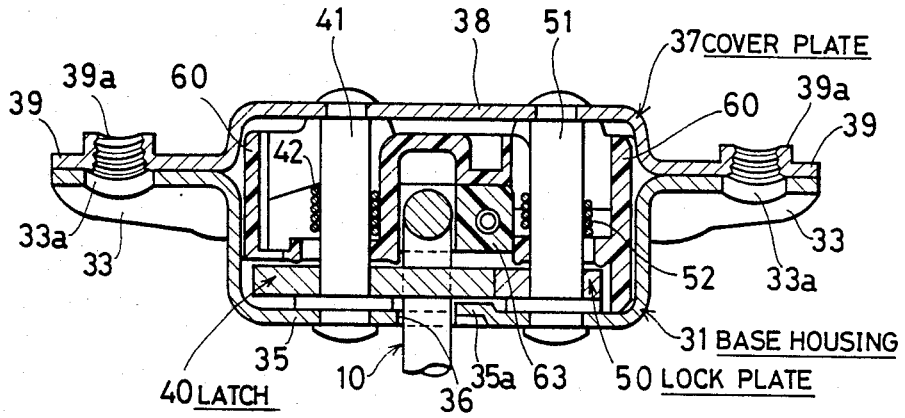
FIG. 2 is a cross-sectional view of the latch mechanism taken along the line II—II shown in FIG. 1A.

As depicted in FIG. 2, the latch mechanism 30 comprises a base housing 31 and a cover plate 37 so as to form a enclosed cross section. The base housing 31 is formed with two mounting flanges 33 and a striker guide opening 36 extending from a front surface 34 to a bottom surface 35 (both shown in FIG. 1B) of the base housing 31. The cover plate 37 is formed with two joint flanges 39. The lock device 20 is fixed to the inner end surface B1 of the back door B by use of two bolts B2. The bolt B2 is inserted into a hole **33*a* formed in the mounting flange 33 and screwed into a burring thread portion (formed into a projecting edge) 39*a* formed in the joint flange 39 of the cover plate 37, in such a way that the major part of the base housing 31** projects outward from the back door end B1, as depicted in FIG. 1A.

Figure 3A:
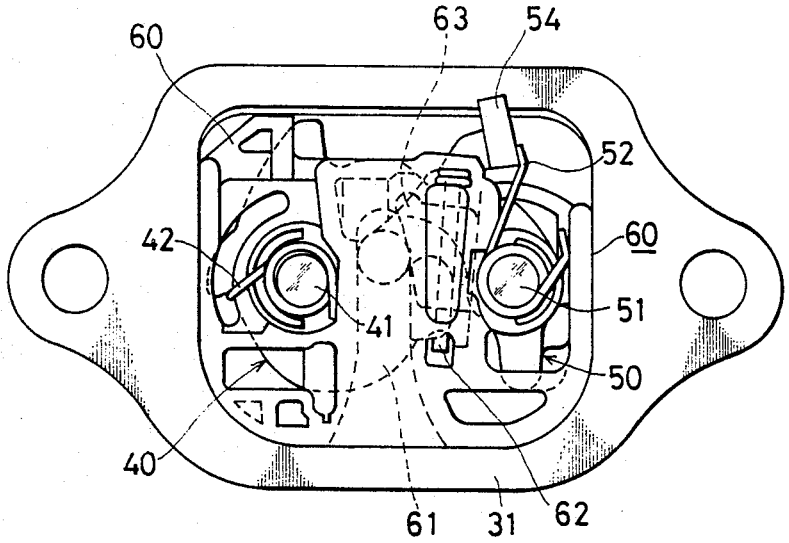
FIG. 3A is a top view showing the latch mechanism when seen from the line III—III shown in FIG. 1A.
Figure 3B:
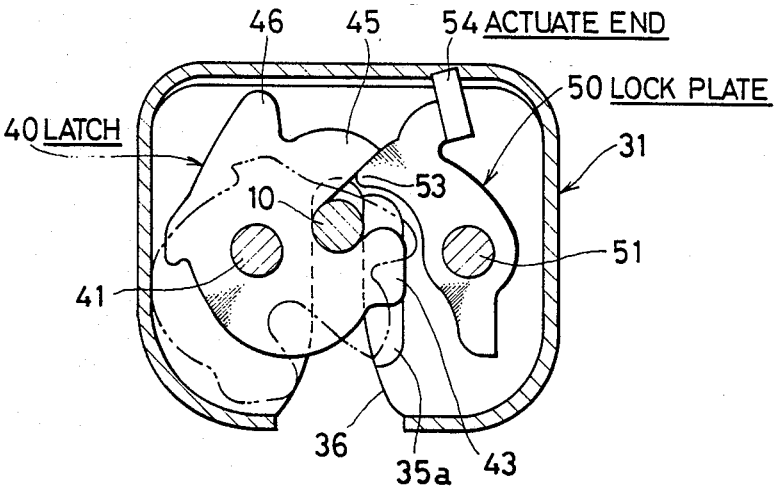
FIG. 3B is a similar top view, partly in cross section, showing only a latch and a lock plate.
Figure 4:
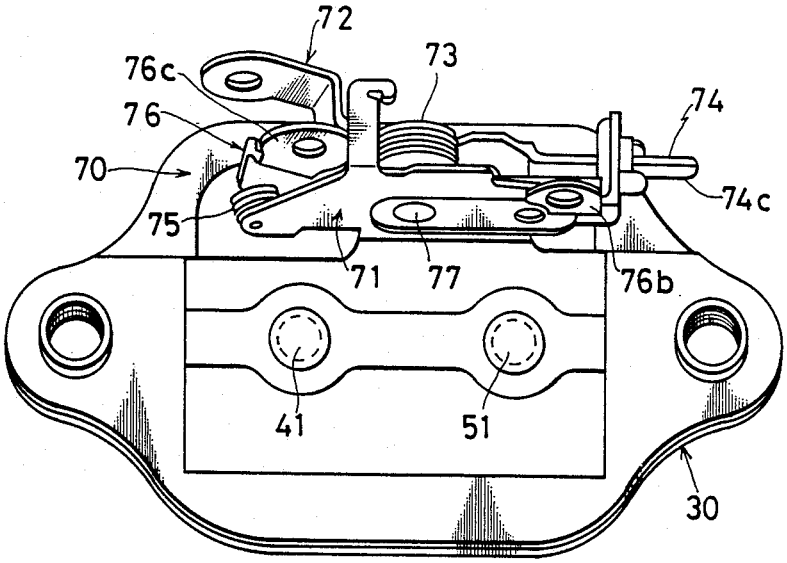
FIG. 4 is a perspective front view showing the lock device when seen from the line IV—IV shown in FIG. 1A.
Figure 5:
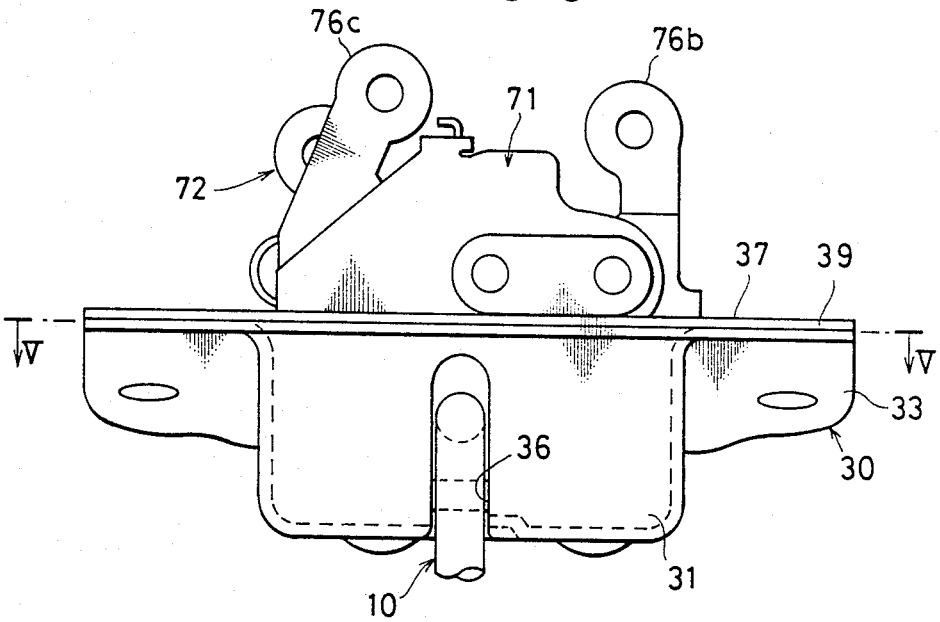
FIG. 5 is a front view showing the lock device when seen from the line V—V shown in FIG. 1A.

As shown in FIGS. 2 and 3A or 3B, the latch 40 is pivotably supported by a support axle 41 fixed by caulking between the base housing 31 and the cover plate 37 and urged by a spring 42 clockwise in FIGS. 3A or 3B so that the bifurcated portion of two fork ends 43 and 45 of the latch 40 faces the striker 10 over a striker guide opening 36. Further, the latch 40 is formed with a half latch end 46 so as to be stopped in contact with the lock plate 50 at an appropriate opening position toward the striker 10.

As shown in FIGS. 2 and 3A or 3B, the lock plate 50 is also pivotably supported by a support axle 51 fixed by caulking between the base housing 31 end the cover plate 37 and urged by a spring 52 counterclockwise in FIGS. 3A or 3B so that a lock end 53 of the lock plate 50 is engageable with the latch 40. Further, the lock plate 50 is formed with an actuate end 54 actuated by the actuator mechanism 70.

In FIG. 3A, a guide rod 62 is disposed in the base housing 31 extending roughly in the movement direction of the striker 10. A wedge 63 is guided along this guide rod 62 being moved up and down (in FIG. 3A) to hold the striker 10 coming inward between the striker guide opening 36 and the wedge side surface.

As shown in FIGS. 1B and 2, a resin body 60 is disposed within the base housing 31 to form a striker guide opening 36 and support various parts. The numeral 64 shown in FIG. 1B denotes a striker stopper also made of resin material.

In summary, when the back door B is closed relative to the vehicle body A, the striker 10 inserts into the base housing 31 of the latch mechanism 30, so that the latch 40 is pivoted counterclockwise (in FIG. 3) and locked by the lock plate 50. To release the lock device 20, the actuate end 54 of the lock plate 50 is actuated by the actuator mechanism 70 described in further detail below.

As depicted in FIG. 1A, a rear portion of the base housing 31 is opened. In more detail, there is formed an opening between the rear end of the cover surface 38 of the cover plate 37 and the rearmost end of the base housing 31. From this opening, the actuate end 54 of the lock plate 50 is projected outward.

The actuator mechanism 70 for actuating this actuate end 54 of the lock plate 50 is mounted on a support plate 71 formed by bending a rear end of the cover plate 37, as depicted in FIG. 1A. This support plate 71 can be formed by bending a rear end of the base housing 31.

Figure 6A:
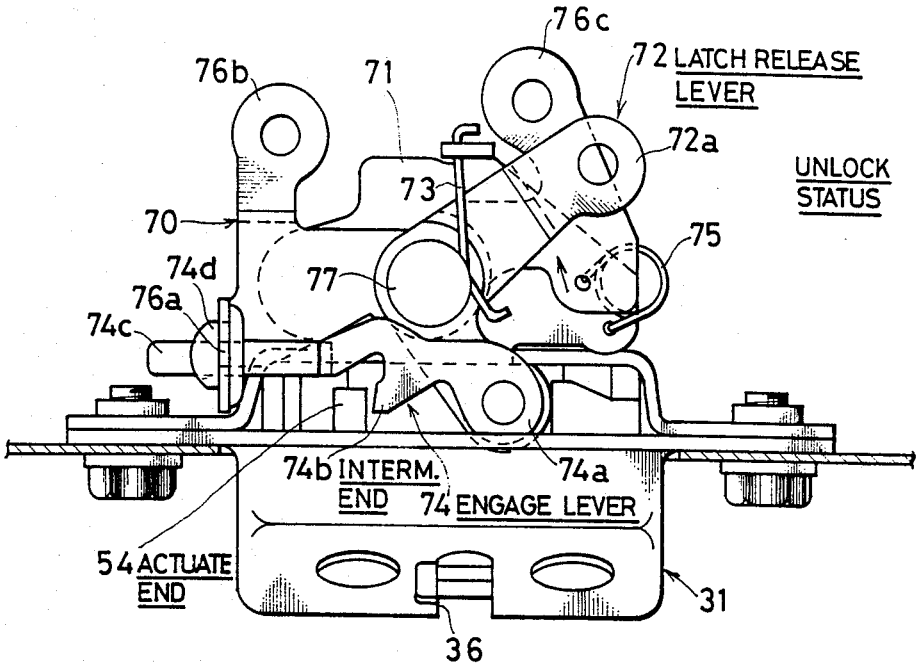
FIG. 6A is a rear view showing an actuator mechanism when seen from the line VI—VI in FIG. 1A.

This actuator mechanism 70 is composed of a latch release lever 72, an engage lever 74 and a lock/unlock plate 76. As depicted in FIG. 6A (rear view), the latch release lever 72 and the lock/unlock plate 76 are coaxially supported by a supported axle 77 disposed at roughly the middle portion of the fixed support plate 71.

One end **72*a* of the latch release lever 72 is connected to a latch release handle (not shown), while the other end of the latch release lever 72 is connected to a pivotal end 74*a* of the engage lever 74, being urged counterclockwise in FIG. 6A by a spring 73**.

The engage lever 74 is formed with an intermediate end **74*b* so as to be engaged with or disengaged from the actuate end 54 of the lock plate 50. Further, a free end 74*c* of this engage lever 74 is slidably inserted into a hole formed at an end 76*a* of the lock/unlock lever 76 via a bush 74*d***.

Figure 6B:
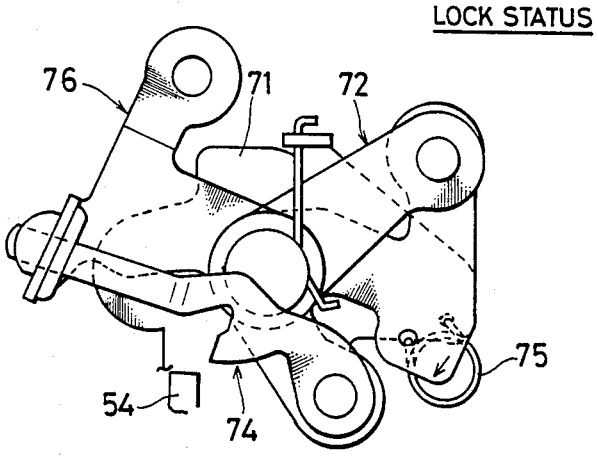
FIG. 6B is a similar view showing only the essential portion of the actuator mechanism.

The lock/unlock plate 76 is formed with a power lock/unlock end **76*b* actuated by a motor for instance and a manual lock/unlock end 76*c* actuated manually via a key cylinder for instance. Further, the right lower end (FIG. 6A) of the lock/unlock plate 76 is connected to the support plate 71 via a turn-over snap spring 75. Therefore, when this lock/unlock lever plate 76 is pivoted clockwise from an unlock stations shown in FIG. 6A, the lock/unlock plate 76** is snapped to a lock status as shown in FIG. 6B.

This is because in the unlock status as shown in FIG. 6A, the lock/unlock plate 76 is urged counterclockwise by the turn-over snap spring 75 relative to the fixed support plate 71. However, when the plate 76 is pivoted clockwise, the turn-over snap spring 75 is reversely pivoted counterclockwise to the lock status as shown in FIG. 6B, where the lock/unlock plate 76 is reversely urged clockwise by the same turn-over snap spring 75 relative to the fixed support plate 71.

The operation of the door lock device 20 according to the present invention will be described hereinbelow.

(1) Engagement between striker 10 and latch mechanism 30 (FIG. 3B):

FIGS. 1A, 1B, 2, 3A, and 3B show this engagement condition. When the back door B is closed to the vehicle body A, the striker 10 pivots the latch 40 located as shown by dot-dot-dashed lines in FIG. 3B counterclockwise, so that the lock plate 50 locks the latch 40 as shown by solid lines in FIG. 3B.

(2) Unlock status (FIG. 6A):

The lock/unlock plate 76 is set counterclockwise as shown in FIG. 6A. When the latch release lever 72 is pivoted clockwise to move the engage lever 74 in the leftward direction, the intermediate end **74*b* thereof is engaged with an actuate end 54 of the lock plate 50. Therefore, the lock plate 50 is pivoted clockwise in FIG. 3A or 3B to release the latch 40, so that the latch is automatically pivoted clockwise by the spring 42 and the striker 10** is released.

(3) Lock status (FIG. 6B):

The lock/unlock plate 76 is set clockwise as shown in FIG. 6B by pulling the power lock/unlock end **76*b* or a manual lock/unlock end 76*c* of the plate 76 and by the aid of the snap action of the turn-over snap spring 75. Under these condition, even if the latch release lever 72 is pivoted clockwise by a cylinder key for instance, since the intermediate end 74*b* of the engage lever 74 is located away from the actuate end 54 of the lock plate 50, it is impossible to move the lock plate 50 clockwise and therefore to release the latch 40**, so that the latch mechanism is kept at a locked status.

In the back door lock device 20 as described above, since the base housing 31 and the cover plate 37 are so formed as to provide a closed cross section and connected by the two latch and lock plate axles 41 and 51, the housing of the lock device or the latch mechanism 20 is fairly improved in strength and rigidity against a shock applied from the striker 10 in the vertical direction in FIG. 2. Further, where striker 10 applies a shock to widen the striker guide 36 in the horizontal direction in FIG. 3B, the base housing 31 can sufficiently withstand against the shock.

Figure 7A:
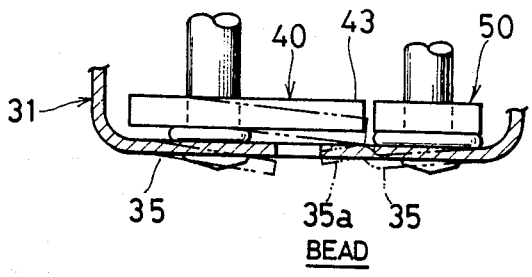
FIG. 7A is a partial cross-sectional view showing the deformation of the housing due to shock for assistance in explaining the function of a bead.

In the base housing 31 shown in FIG. 2, the numeral **35*a* denotes a projecting bead formed in the bottom support surface 35*a* of the base housing 31. This projecting bead 35 spreads as shown in FIG. 3B so as to be located just below the fork end 43 of the latch 40 with a small gap between the bead 35*a* and the latch 40. This bead 35*a* serves to support the latch 40 so that the latch is not disengaged from the lock plate 50 when an abnormal shock is applied to the latch mechanism 30 as shown in FIG. 7A, thus increasing the safety against disengagement between the latch 40 and the lock plate 50**.

Figure 7B:
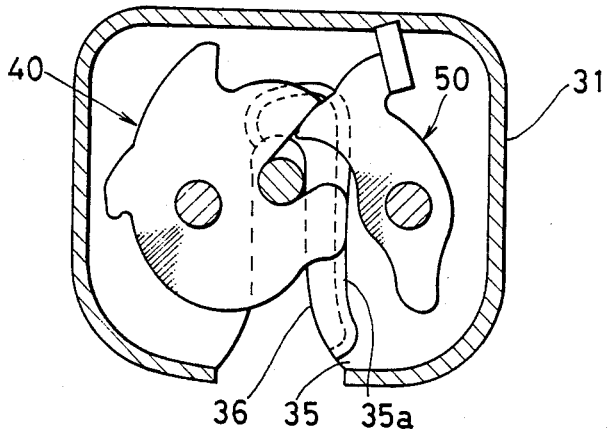
FIG. 7B is a top view showing another modification of the bead formed in the base housing of the latch mechanism according to the present invention.

FIG. 7B shows another modification of the projecting bead **35*a*, in which the bead 35*a* extends to the innermost part of the striker guide opening 36** to further securely support the engagement relationship between the latch and the lock plate in case a shock is applied thereto, so that it is possible to further increase the resistance against shock.

Figure 8:
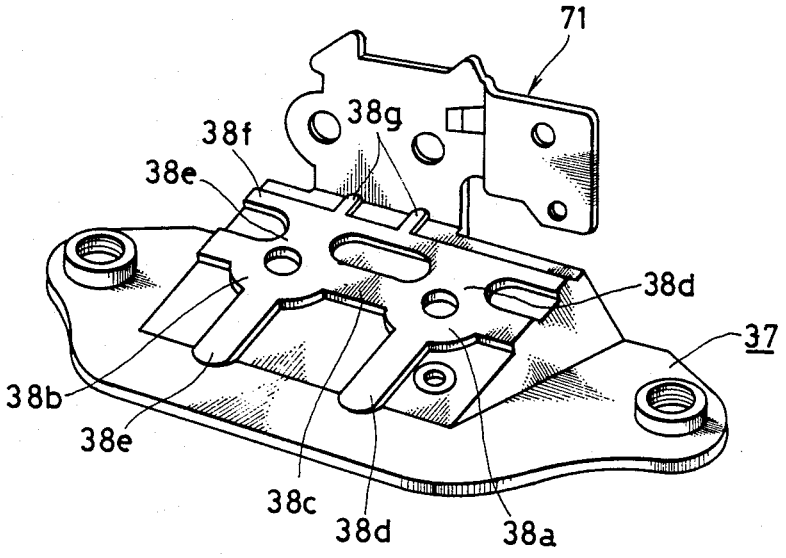
FIG. 8 is a perspective view showing a modification of the cover plate according to the present invention.

FIG. 8 shows a modification of the cover plate 37, in which various projecting seats and projecting beads are formed for further improving the strength of the cover plate 37 or the latch mechanism 30. A projecting seat **38*a* is formed at a position where the latch support axle 41 is supported; a projecting seat 38*b* is formed at a position where the lock plate support axle 41 is supported; a straight bead 38*c* is formed between the two seats 38*a* and 38*b*; a straight bead 38*d* is formed extending from the seat 38*a* on both sides thereof; a straight bead 38*e* is formed extending from the seat 38*b* on both sides thereof; a straight bead 38*f* is formed in parallel with the straight bead 38*c*; and two straight beads 38*g* is formed from the straight beam 38*f* to the support plate 71 of the actuator mechanism 70. All these beads are connected to each other via the two seats 38*a* and 38*b*** and extending in every direction. The height of each of these beads is substantially the same as that of the seats. The presence of these beads serve to further increase the strength and the rigidity of the housing and therefore the lock device against accident shock applied thereto.

What is claimed is:

1. A door lock device for an automotive vehicle attached to a vehicle door to lock/unlock the vehicle door to a vehicle body via a striker provided in the vehicle body, which comprises:

(a) a base housing having a mounting flange portion on opposite sides thereof;

(b) cover plate means having a joint flange portion on opposite sides thereof for mating engagement with said mounting flange portions for forming an enclosure with said base housing;

(c) cooperating latch means and lock plate means pivotally supported by respective support axles fixedly connected between said base housing and said cover plate means for locking engagement with the striker; and (d) said base housing including a surface having a projecting bead extending therefrom and spreading over an engagement area between said latch means and said lock plate means so as to reduce play between said base housing and said latch means for prevention of disengagement between said latch means and said plate against shock applied to the door lock device.

2. The door lock device according to claim 1, wherein said projecting bead extends to an innermost end of a striker opening formed in said base housing.

* * * * *